US009914614B2

(12) United States Patent
Tsutsumi et al.

(10) Patent No.: US 9,914,614 B2
(45) Date of Patent: Mar. 13, 2018

(54) SHEET, SHEET CONVEYING APPARATUS AND SHEET CONVEYING METHOD

(71) Applicant: FUJI XEROX CO., LTD., Tokyo (JP)

(72) Inventors: Kojiro Tsutsumi, Ebina (JP); Toshiyasu Yukawa, Ebina (JP); Katsumi Harada, Ebina (JP); Kunishirou Takeda, Warabi (JP)

(73) Assignee: FUJI XEROX CO., LTD., Tokyo (JP)

( * ) Notice: Subject to any disclaimer, the term of this patent is extended or adjusted under 35 U.S.C. 154(b) by 259 days.

(21) Appl. No.: 14/644,675

(22) Filed: Mar. 11, 2015

(65) Prior Publication Data

US 2016/0090265 A1 Mar. 31, 2016

(30) Foreign Application Priority Data

Sep. 26, 2014 (JP) ..... 2014-197320
Sep. 26, 2014 (JP) ..... 2014-197452

(51) Int. Cl.

| | |
|---|---|
| ***B65H 37/06*** | (2006.01) |
| ***B42D 15/00*** | (2006.01) |
| ***B65H 45/30*** | (2006.01) |
| ***B31F 1/08*** | (2006.01) |

(52) U.S. Cl.

CPC ..... *B65H 37/06* (2013.01); *B31F 1/08* (2013.01); *B42D 15/008* (2013.01); *B65H 45/30* (2013.01); *B42P 2241/22* (2013.01); *B65H 2301/5126* (2013.01); *B65H 2701/122* (2013.01)

(58) Field of Classification Search

CPC ..... B31F 1/08; B31F 1/10; B31F 1/20; B31F 1/0012; B31F 1/0022; B31F 1/0025; B31D 1/022; B42D 15/008; B65H 45/12; B65H 45/22; B65H 45/30; B65H 37/06; Y10T 428/24628; Y10T 428/24669; Y10T 428/24479; Y10T 428/2457; Y10T 428/24455; Y10T 428/24446

USPC ..... 428/172, 174, 156, 167

See application file for complete search history.

(56) References Cited

U.S. PATENT DOCUMENTS

2006/0261542 A1 11/2006 Collings
2014/0357463 A1* 12/2014 Kojima ..... B65H 45/30 493/442

FOREIGN PATENT DOCUMENTS

CN 1865105 A 11/2006
JP 2000229492 A 8/2000
WO WO 2012076610 A1 * 6/2012 ..... B65D 5/4266
WO WO 2013164877 A1 * 11/2013 ..... B65H 45/30

OTHER PUBLICATIONS

Jun. 28, 2017 Office Action issued in Chinese Patent Application No. 201510187451.5.

* cited by examiner

*Primary Examiner* — Catherine A Simone
(74) *Attorney, Agent, or Firm* — Oliff PLC

(57) ABSTRACT

An embodiment of the invention is directed to a sheet, wherein a conveying direction of the sheet relative to a sheet conveying apparatus is determined; the sheet is formed with a crease along which to fold the sheet and that is smaller than or equal to 90 μM in depth and extends in a direction that crosses the conveying direction; and a grammage of the sheet is in a range of 200 to 370 g/m$^2$.

17 Claims, 14 Drawing Sheets

| CREASE DEPTH (μm) | 15 | 25 | 35 | 43 | 51 | 55 | 59 | 63 | 75 | 89 | 110 | 180 |
|---|---|---|---|---|---|---|---|---|---|---|---|---|
| BREAK-AT-CREASE (GRADE) | G4 | G3 | G2.5 | G1 | G1 | G1 | G1 | G1 | G1 | G1 | G1 | G1 |
| CONVEYANCE FAILURE RATE (%) | 0 | 0 | 0 | 0 | 0 | 0 | 0 | 0 | 0 | 0 | 0.1 | 1.0 |

| Grade | DEGREE OF EASINESS OF FOLDING | APPEARANCE OF FOLDS |
|---|---|---|
| G1 | VERY EASY TO FOLD | VERY FINE |
| G2 | EASY TO FOLD | FINE |
| G3 | FOLDING POSITIONS DEVIATE | WRINKLES ARE FORMED AROUND CREASES OR FLUFFING OCCURS AT FOLDS |
| G4 | CANNOT BE FOLDED ALONG CREASES | PAPER LAYER BREAKS OCCUR AT FOLDS |

SHEET, SHEET CONVEYING APPARATUS AND SHEET CONVEYING METHOD

CROSS-REFERENCE TO RELATED APPLICATIONS

This application is based on and claims priority under 35 USC 119 from Japanese Patent Application No. 2014-197320 filed on Sep. 26, 2014 and Japanese Patent Application No. 2014-197452 filed on Sep. 26, 2014.

BACKGROUND

1. Technical Field

The present invention relates to a sheet, a sheet conveying apparatus, and a sheet conveying method.

2. Related Art

Among sheets formed with creases are ones for formation of a flat file folder. To form a flat file folder, at least a front cover and a back cover are formed by folding a single sheet along creases. And a document or the like is bound so as to be contained in the inside space between the front cover and the back cover. There are various sheets of that kind such as a sheet in which a portion to become a spine is formed between a front cover portion and a back cover portion and a sheet having an attachment portion to which a binder is to be attached.

SUMMARY

According to an aspect of the invention, there is provided a sheet characterized in that a conveying direction of the sheet relative to a sheet conveying apparatus is determined; that the sheet is formed with a crease along which to fold the sheet and that is smaller than or equal to 90 μm in depth and extends in a direction that crosses the conveying direction; and that the grammage is in a range of 200 to 370 g/m$^2$.

BRIEF DESCRIPTION OF THE DRAWINGS

FIG. 12A illustrates how to form a concave crease and FIG. 12B illustrates how to form a convex crease.

DESCRIPTION OF SYMBOLS

10 . . . Sheet; 10*a* . . . Front surface; 10*b* . . . Back surface; 15, 16, 17, 18 . . . Creases; 15*b* . . . Downstream-side falling portion; 15*c* . . . Upstream-side falling portion; 17*b* . . . Downstream-side rising portion; 17*c* . . . Upstream-side rising portion; 100 . . . Flat file folder; 300 . . . Image forming apparatus; Z . . . Conveying direction.

DETAILED DESCRIPTION

An exemplary embodiment of the present invention will be hereinafter described with reference to the accompanying drawings.

<Sheet for Flat File Folder>

Figure 1:
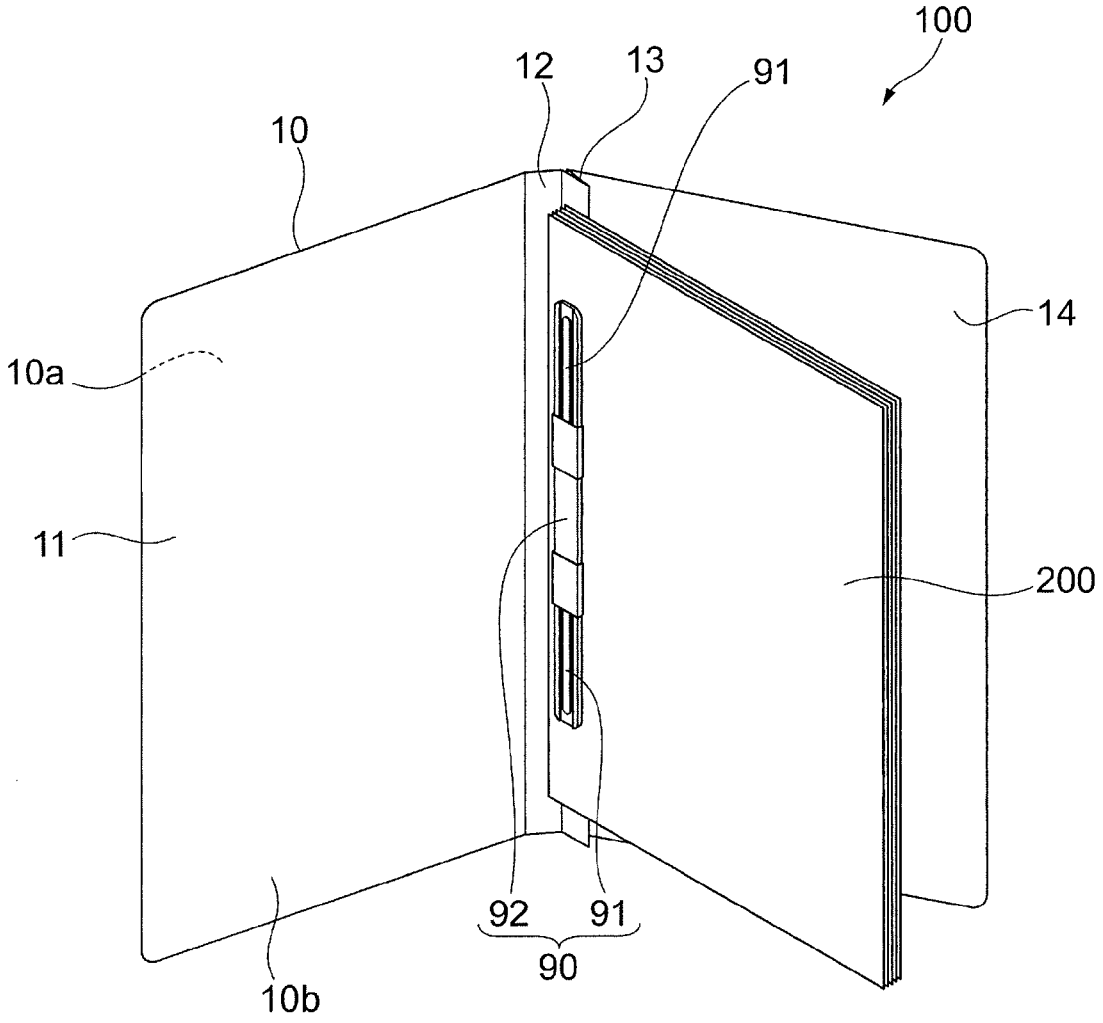
FIG. 1 is a perspective view of a flat file folder that is made of a sheet according to an exemplary embodiment of the present invention.
Figure 2:
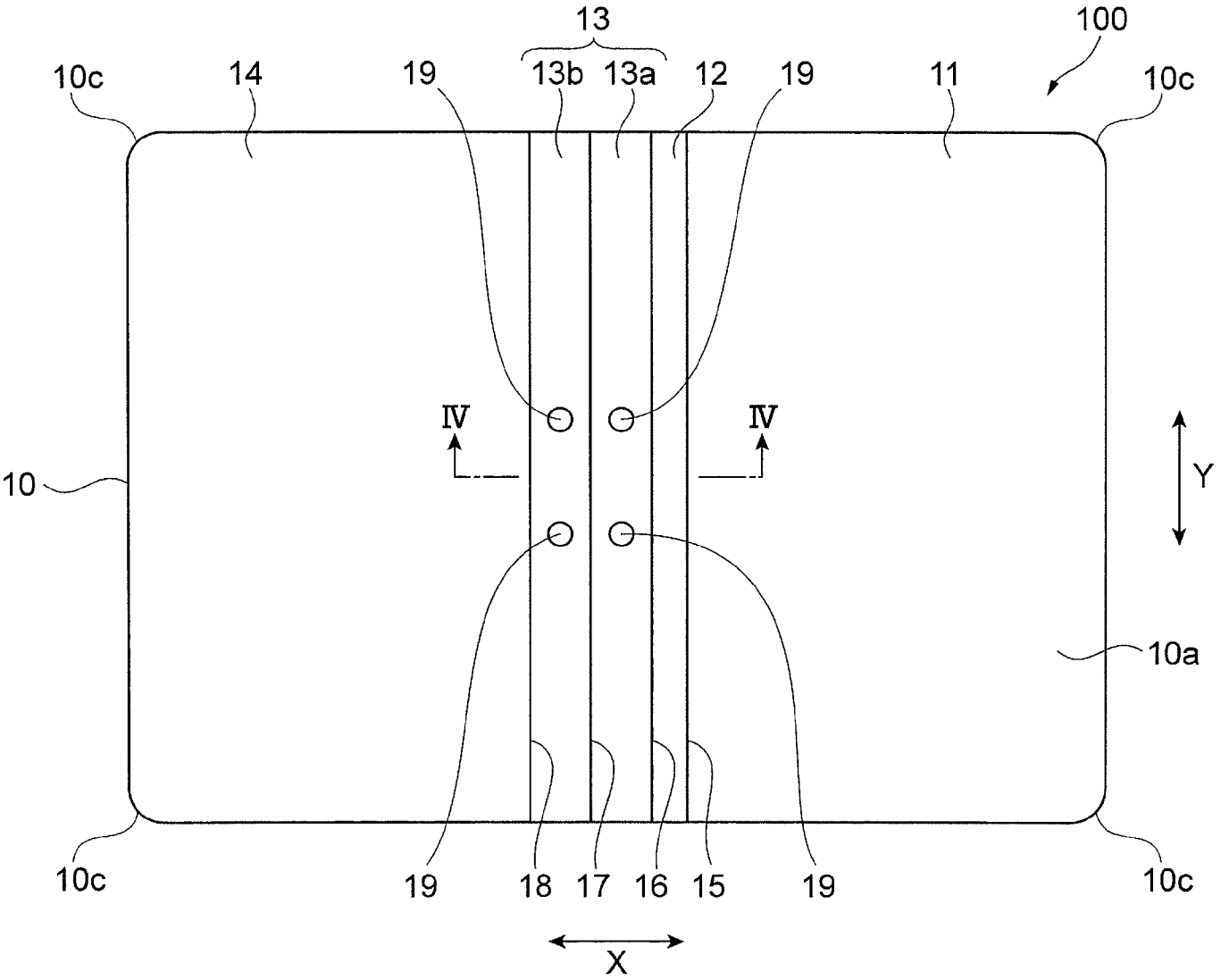
FIG. 2 is a plan view of the sheet and shows its front surface.

FIG. 1 is a perspective view of a flat file folder 100 which is made of a sheet 10 according to the exemplary embodiment of the invention. FIG. 2 is a plan view of the sheet 10 and shows its front surface 10*a*.

The flat file folder 100 shown in FIG. 1 is composed of the sheet 10 which serves as a cover when a document 200 is filed inside and a binder 90 which binds the document 200 that is set inside the sheet 10 folded.

As shown in FIG. 2, the binder 90 has two binding bands 91 which are inserted through respective holes (not shown) formed in the document 200 and a pusher 92 which fixes the document 200 by pressing the binding bands 91.

As shown in FIG. 2, the sheet 10 is flat and is made of a single paperboard, for example. The paperboard is not limited to a multilayer (i.e., laminated) paperboard and may be a single-layer paperboard. Four corner portions of the sheet 10 are rounded. The sheet 10 is formed with plural (in this example, four) creases 15 to 18 which extend in its shorter-axis direction Y which is perpendicular to its longitudinal direction.

The creases 15, 16, and 18 are creases for mountain fold that are to be folded to become convex toward the viewer's side in FIG. 2. On the other hand, the crease 17 is a crease for valley fold that is to be folded to become concave toward the viewer's side in FIG. 2. When the flat sheet 10 is folded along the creases 15 to 18, it is shaped into a three-dimensional cover as shown in FIG. 1.

As shown in FIG. 2, the crease 15 is a crease that partitions the three-dimensional sheet 10 (see FIG. 1) into a portion 11 to serve as a front cover (hereinafter referred to as a front cover portion 11) and a portion 12 to serve as a spine (hereinafter referred to as a spine portion 12). The crease 16 is a crease that separates the spine portion 12 from an attachment portion 13 to which the binder 90 is to be attached. The crease 18 is a crease that separates the attachment portion 13 from a portion 14 to serve as a back cover (hereinafter referred to as a back cover portion 14).

The attachment portion 13 is formed by placing on each other a first attachment portion 13*a* which is adjacent to the spine portion 12 and a second attachment portion 13*b* which is adjacent to the back cover portion 14, and the crease 17 serves to separate the first attachment portion 13*a* and the second attachment portion 13*b* from each other. The first attachment portion 13*a* and the second attachment portion 13*b* are placed on each other in such a manner that their surfaces that are portions of the front surface 10*a* of the sheet 10 are opposed to each other. When the sheet 10 is in a three-dimensional state and is part of the flat file folder 100, the first attachment portion 13*a* and the second attachment portion 13*b* are kept placed on each other by means of a double-sided adhesive tape, staples, or the like.

Two circular attachment holes 19 are formed through each of the first attachment portion 13*a* and the second attachment portion 13*b* so as to be arranged in the shorter-axis direction Y. In a state that the first attachment portion 13*a* and the second attachment portion 13*b* placed on each other, the two attachment holes 19 of the first attachment portion 13*a* are in registration with those of the second attachment portion 13*b* each other, respectively.

Each binding band 91 (see FIG. 1) one end portion of which is larger than the diameter of the attachment hole 19 is inserted through the corresponding attachment hole 19 from the side of the second attachment portion 13*b*. A portion, projecting to the side of the first attachment portion 13*a* from the corresponding attachment hole 19, of the each binding band 91 passes through bonding holes formed through document pages 200 (see FIG. 1) and is pressed by the pusher 92 of the binder 90. As a result, the document pages 200 are fixed to the attachment portion 13 and thereby filed in the flat file folder 100.

<Setting of Sheets in Sheet Conveying Apparatus>

Figure 3:
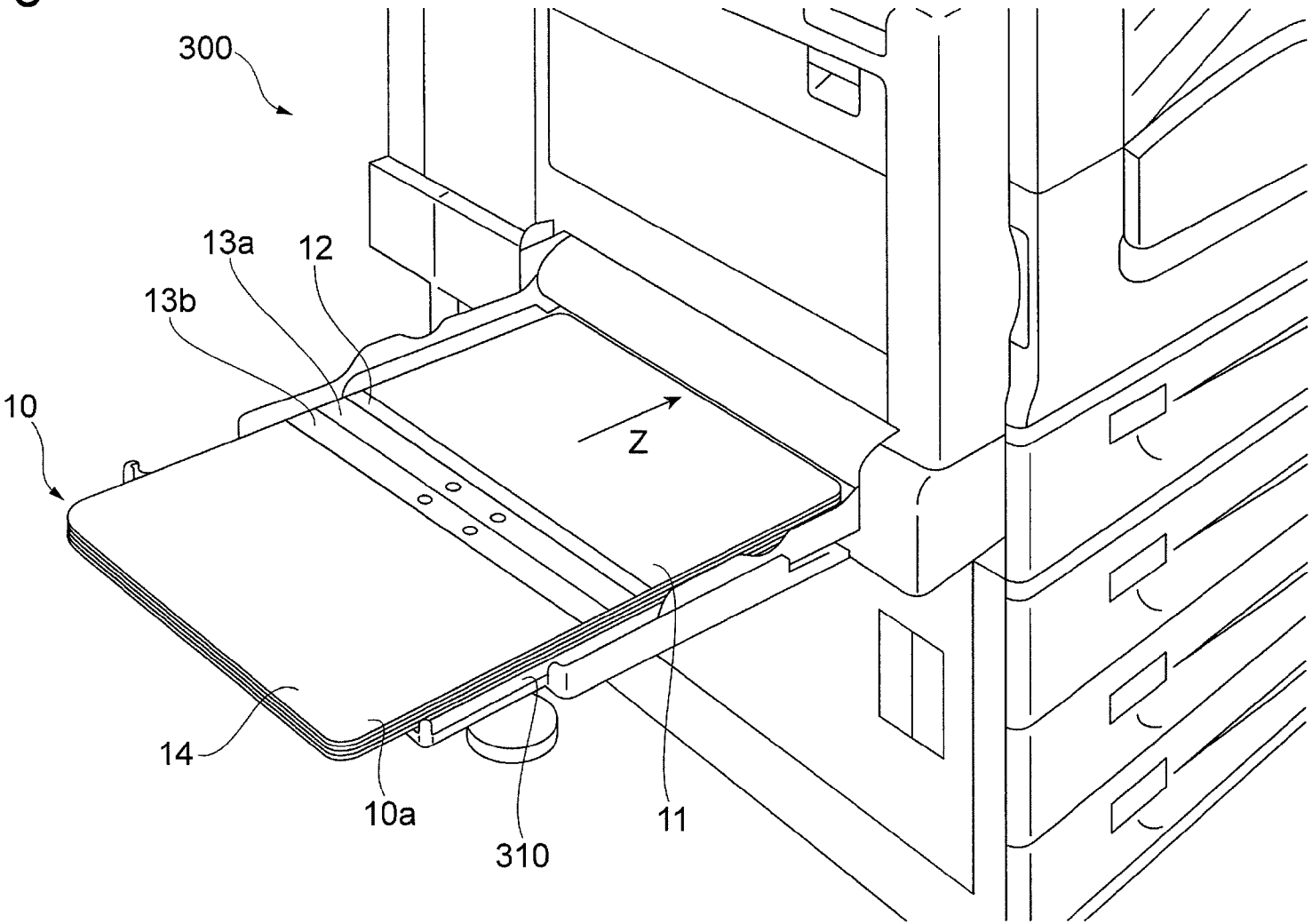
FIG. 3 is a schematic perspective view showing a state that plural (e.g., 10) sheets are stacked and set on a manual feed tray of an image forming apparatus that has a function of printing image information of a text etc. on a sheet.

FIG. 3 is a schematic perspective view showing a state that plural (e.g., 10) sheets 10 are stacked and set on a manual feed tray 310 of an image forming apparatus 300 which has a function of printing image information of a text etc. on a sheet 10. The image forming apparatus 300 employed in the exemplary embodiment is an example of a sheet conveying apparatus. The manual feed tray 310 is an example of a sheet bearing unit on which sheets 10 to be mounted are stacked. However, the invention can also be applied to other sheet conveying apparatus such as a post-processing apparatus which performs post-processing such as hole punching or stapling on a printed sheet 10 and an independent sheet feeder which feeds a sheet 10.

As shown in FIG. 3, the image forming apparatus 300 conveys a flat sheet 10 that has not been folded along creases 15 to 18 (see FIG. 2), from the manual feed tray 310 in the conveying direction Z. The image forming apparatus 300 performs printing on the top surface (in a state that the sheet 10 is placed on the manual feed tray 310) of a sheet 10 while conveying it in downstream in the conveying direction Z (see FIG. 3).

The image forming apparatus 300 performs printing on a portion (s) of the front surface 10*a* of the sheet 10, that is, the front surface (s) of at least one of the front cover portion 11, the spine portion 12, and the back cover portion 14. For example, the contents of information to be printed are a title, an author name or a person who provides it, and a destination party of a document 200 (see FIG. 1) to be filed in a resulting flat file folder 100, an image such as a logo mark or a photograph, etc.

In setting a sheet 10 on the manual feed tray 310 of the image forming apparatus 300, it needs to be set with its front surface 10*a* up. This is because printing is performed on the back surface of the sheet 10 if it is set with its back surface 10*b* (see FIG. 1) up.

In setting a sheet 10 on the manual feed tray 310 of the image forming apparatus 300, it needs to be set in such a manner that its front cover portion 11 is located downstream of its back cover portion 14 in the conveying direction Z of the image forming apparatus 300. This is because information that a user intends to print on, for example, the front cover portion 11 is printed on the back cover portion 14 upside down if it is set in such a manner that the back cover portion 14 is located downstream of the front cover portion 11.

In the exemplary embodiment, the conveying direction Z relative to the image forming apparatus 300 is determined so as be suitable for the orientation of a sheet 10 that its front cover portion 11 is located downstream of its back cover portion 14 in the conveying direction Z. The creases 15 to 18 extend so as to be perpendicular to the conveying direction Z of the image forming apparatus 300.

<Details of Creases of Sheet (First Mode of the Invention)>

Figure 4A:
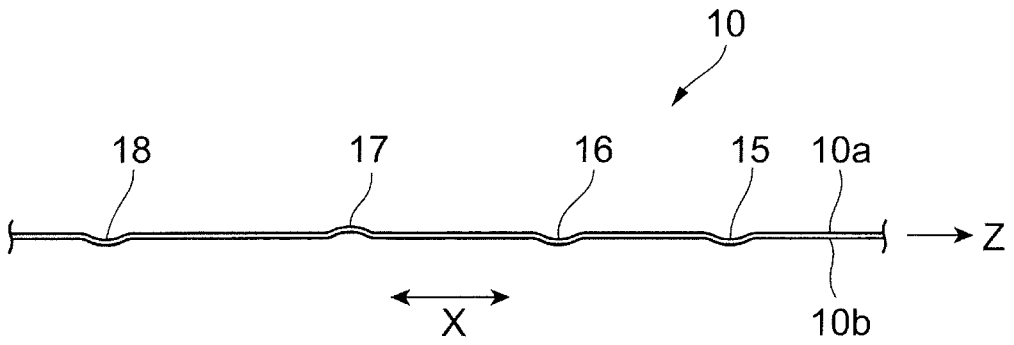
FIG. 4A is a sectional view taken along line IV-IV in FIG. 2.
Figure 4B:
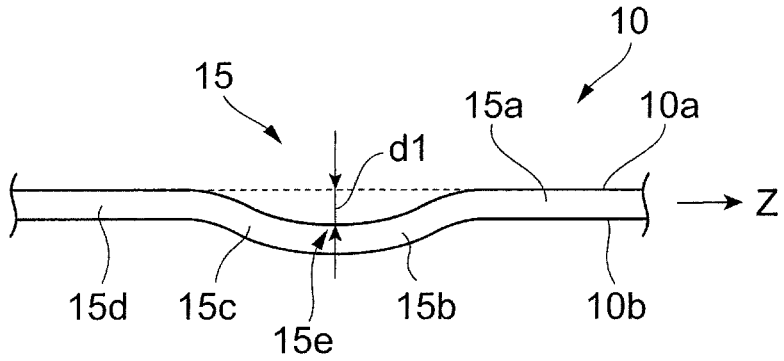
FIG. 4B is an enlarged view of a concave crease in FIG. 4A.
Figure 4C:
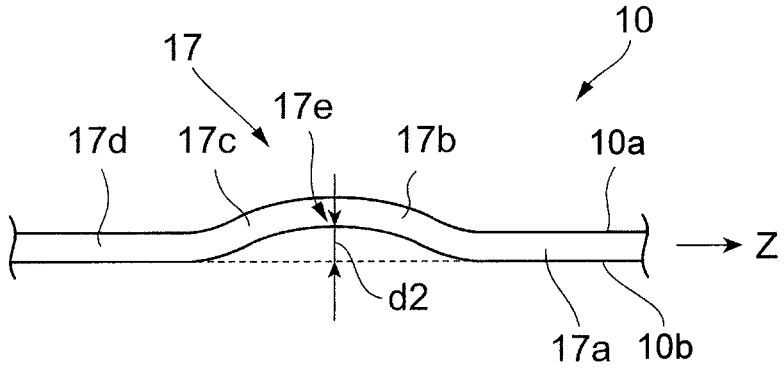
FIG. 4C is an enlarged view of a convex crease in FIG. 4A.

FIG. 4A is a sectional view taken along line IV-IV in FIG. 2, FIG. 4B is an enlarged view of the concave crease 15 in FIG. 4A, and FIG. 4C is an enlarged view of the convex crease 17 in FIG. 4A. When as shown in FIG. 3 a sheet 10 is placed on the manual feed tray 310 with its front surface 10*a* up, as shown in FIG. 4A the creases 15, 16, and 18 for mountain fold of the sheet 10 are concave upward (i.e., recessed downward). On the other hand, the crease 17 for valley fold of the sheet 10 is convex upward.

In the exemplary embodiment, as shown in FIG. 4B, the upstream portion and the downstream portion, in the conveying direction Z, of the concave crease 15 are approximately symmetrical. That is, a downstream-side falling portion 15*b* and an upstream-side falling portion 15*c* are approximately identical in inclination.

Like the crease 15, each of the other concave creases 16 and 18 is shaped in such a manner that the upstream portion and the downstream portion in the conveying direction Z are approximately symmetrical. That is, a downstream-side falling portion 16*b* and an upstream-side falling portion 16*c* of the crease 16 are approximately identical in inclination. And a downstream-side falling portion 18*b* and an upstream-side falling portion 18*c* of the crease 18 are approximately identical in inclination. Also see FIG. 5.

As shown in FIG. 4C, the upstream portion and the downstream portion, in the conveying direction Z, of the concave crease 17 are also approximately symmetrical. That is, a downstream-side rising portion 17*b* and an upstream-side rising portion 17*c* are approximately identical in inclination.

Figure 5:
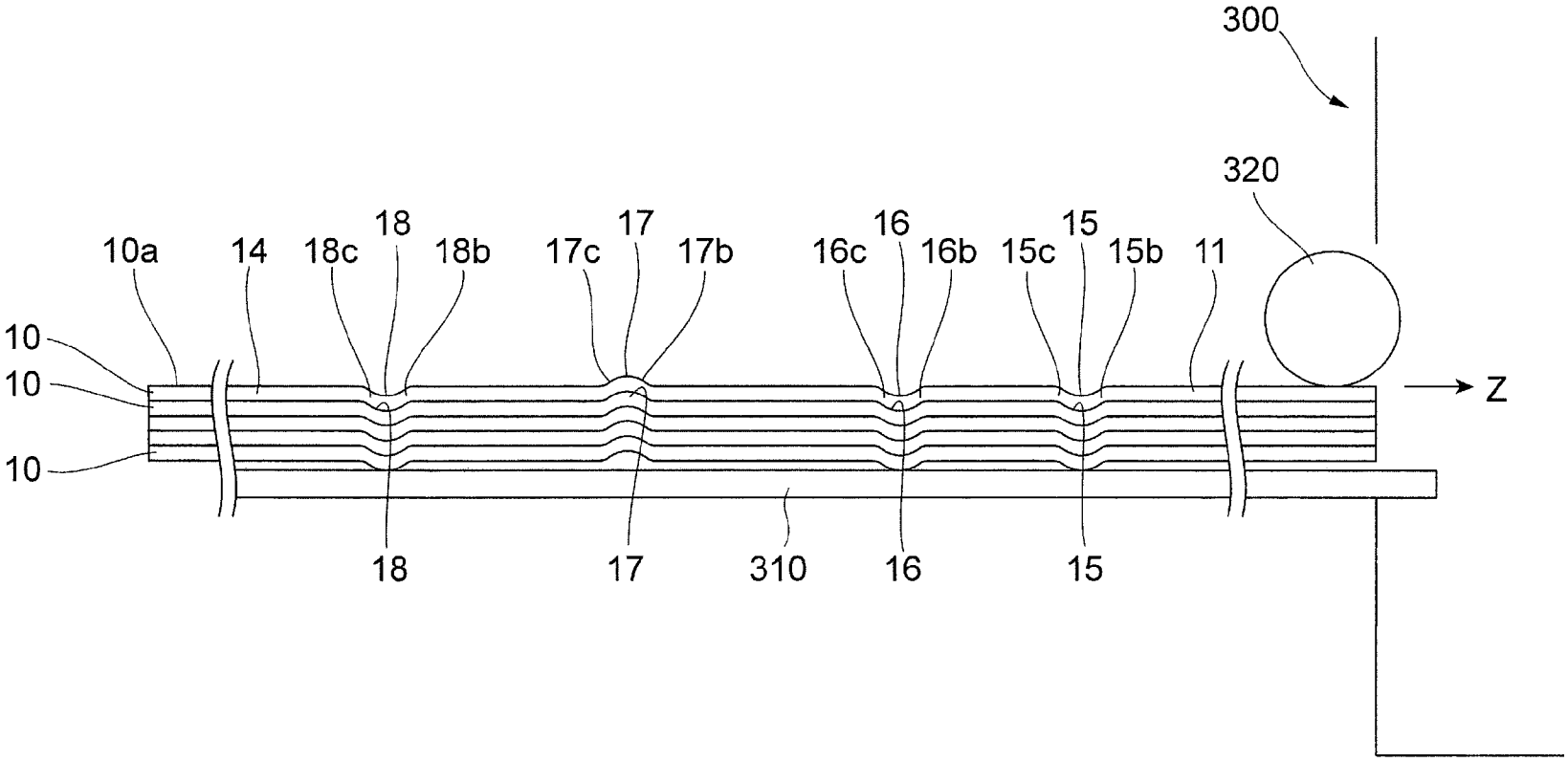
FIG. 5 is a schematic sectional view showing how plural sheets are stacked on the manual feed tray of the image forming apparatus.
Figure 6:
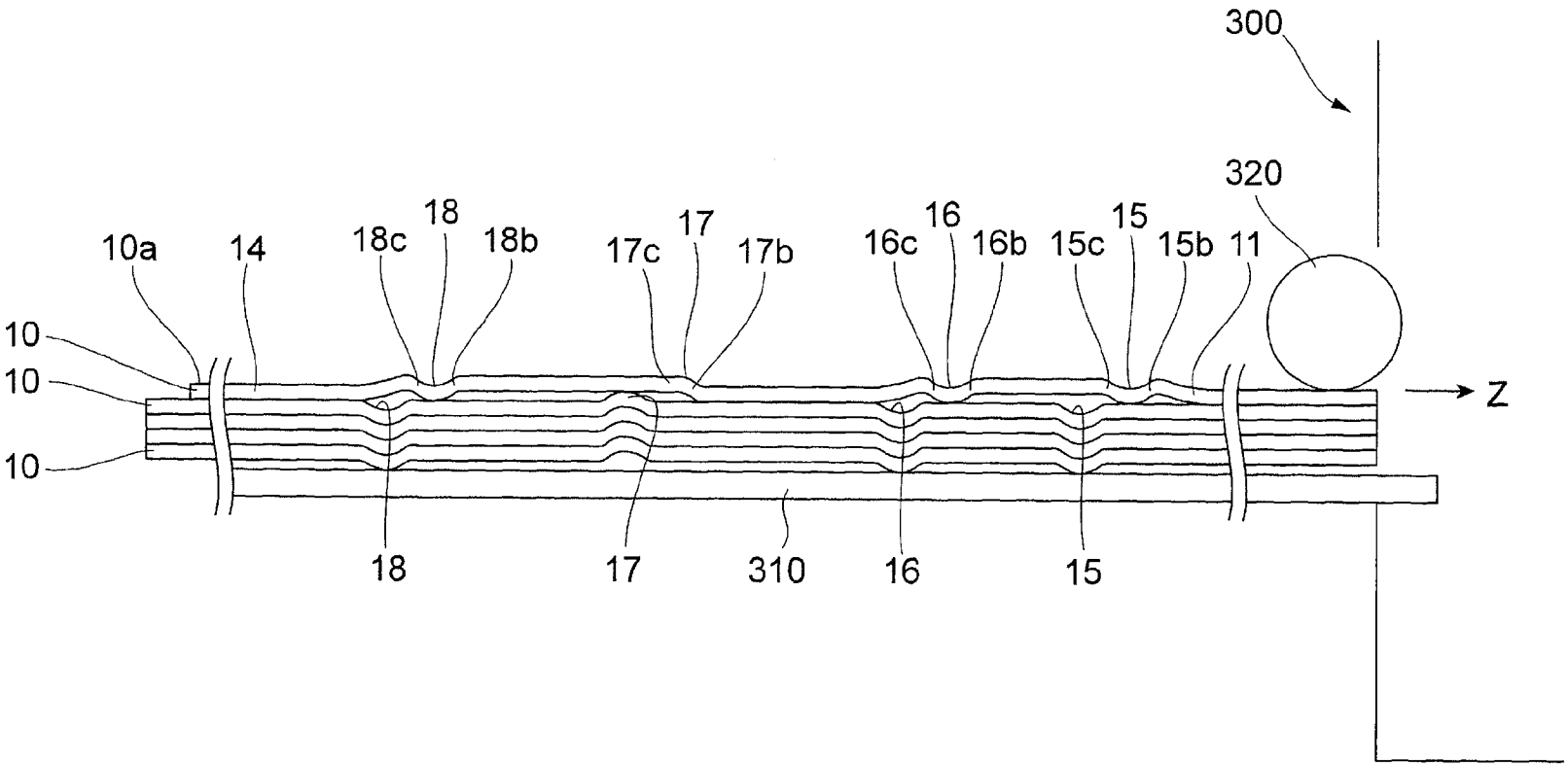
FIG. 6 is a schematic sectional view, which corresponds to FIG. 5, showing how the topmost one of the sheets shown in FIG. 5 is conveyed in the conveying direction.

FIG. 5 is a schematic sectional view showing how plural sheets 10 are stacked on the manual feed tray 310 of the image forming apparatus 300. FIG. 6 shows how the topmost one of the sheets 10 shown in FIG. 5 is conveyed in the conveying direction Z.

In the exemplary embodiment, as shown in FIG. 5, plural sheets 10 are stacked and set on the manual feed tray 310 of the image forming apparatus 300. As shown in FIG. 6, the plural sheets 10 thus set are conveyed in the conveying direction Z one by one starting from the topmost one. A feed roll 10 can be regarded as an example of a conveying unit.

During that course, hooking may occur between the concave creases 15, 16, and 18 of the topmost sheet 10 and those of the immediately underlying sheet 10. For example, the downstream-side falling portion 15*b* of the concave crease 15 of the topmost sheet 10 may be caught on that of the immediately underlying sheet 10. Likewise, the downstream-side falling portion 16*b* or 18*b* of the concave crease 16 or 18 of the topmost sheet 10 may be caught on that of the immediately underlying sheet 10.

Hooking may also occur between the convex creases 17. That is, the upstream-side rising portion 17*c* of the convex crease 17 of the topmost sheet 10 may be caught on that of the immediately underlying sheet 10.

If hooking occurs between creases, the topmost sheet 10 cannot be conveyed by the feed roll 320, which means a conveyance failure.

In the exemplary embodiment, hooking between creases is prevented by having the concave creases 15, 16, and 18 and the convex crease 17 satisfy the following conditions.

As described above, the sheet 10 used in the exemplary embodiment is, for example, a paperboard whose grammage is 200 to 370 g/m$^2$ (preferably 260 to 300 g/m$^2$). For the sheet 10 in this grammage range, the depth of the creases 15 to 18 is set as follows.

In the exemplary embodiment, the depth d1 of the concave crease 15 (see FIG. 4B) is set smaller than or equal to 90 μm. The depth d1 of the concave crease 15 is defined as the distance between the front surface 10*a* of the sheet 10 and a deepest point 15*e* of the crease 15. Therefore, it can be said that the crease 15 has such a concave shape as to be recessed by the depth d1 from the front surface of a flat portion 15*a* downstream of the crease 15 in the conveying direction Z and a flat portion 15*d* upstream of the crease 15 toward the back surface 10*b* of the sheet 10 (i.e., downward). This setting is also applied to the other concave creases 16 and 18; their depth is also set smaller than or equal to 90 μm.

In the exemplary embodiment, the depth d2 of the convex crease 17 (see FIG. 4C) is set smaller than or equal to 90 μm. The depth d2 of the concave crease 15 is defined as the distance between the back surface 10*b* of the sheet 10 and a deepest point 17*e* of the crease 17. Therefore, it can be said that the crease 17 has such a convex shape as to project by the depth d2 from the back surface of a flat portion 17*a* downstream of the crease 17 in the conveying direction Z and a flat portion 17*d* upstream of the crease 17 toward the front surface 10*a* of the sheet 10 (i.e., upward).

By setting the depth d1 of the concave creases 15, 16, and 18 and the depth d2 of the convex crease 17 smaller than or equal to a predetermined value in the above-described manner, the above-described hooking between creases is made less prone to occur, that is, one or some of the creases 15 to 18 of the topmost sheet 10 being conveyed are made less prone to be caught on one or some of the creases 15 to 18 of the immediately underlying sheet 10. This is because, as for, for example, the concave crease 15, its downstream-side falling portion 15*b* of the topmost sheet 10 is made less prone to be caught on the downstream-side falling portion 15*b* of the immediately underlying sheet 10. The same if true of the other creases 16, 17, and 18. That is, the downstream-side falling portion 16*b* of the concave crease 16, the upstream-side rising portion 17*c* of the convex crease 17, and the downstream-side falling portion 18*b* of the concave crease 18 of the topmost sheet 10 are made less prone to be caught on those of the immediately underlying sheet 10, respectively. As a result, sheets 10 are made less prone to a conveyance failure.

Hooking between creases is made less prone to occur as the depth of the creases 15 to 18 is set smaller. However, the depth of the creases 15 to 18 is set too small, it becomes difficult for users to fold the sheet 10 along the creases 15 to 18. And another problem arises that the sheet 10 become prone to break at the creases 15 to 18. This break-at-crease is a phenomenon that when the sheet 10 is folded at the crease 15, 16, 17, or 18, stress is concentrated on its bottom or peak portion to cause paper layer breaks, fiber fluffing, or the like. A sheet 10 with a break-at-crease renders a resulting flat file folder 100 poor in appearance.

Therefore, the depth of the creases 15 to 18 should have a lower limit. The inventors found that a break-at-crease is prone to occur if the depth of the creases 15 to 18 is larger than or equal to 40 μm. In the exemplary embodiment, this value is employed as a lower limit of the depth of the creases 15 to 18.

Taking all factors into consideration, it is concluded that when the grammage of the sheet 10 is in the range of 200 to 370 g/m$^2$, the depth of the creases 15 to 18 should be in the range of 40 to 90 μm.

Although in the above description the specific value range is set for the depth of the creases 15 to 18, it may be delimited in a different manner. For example, it can be said that the depth of the creases 15 to 18 should be larger than a value below which a break-at-crease tends to occur when the sheet 10 is folded at the creases 15 to 18 and smaller than a value above which a conveyance failure tends to occur due to hooking between the creases 15 to 18 of the topmost sheet 10 and those of the immediately underlying sheet 10 when the topmost one of plural sheets 10 stacked on the manual feed tray 310 of the image forming apparatus 300 is conveyed.

Where sheets 10 whose grammage is in the range of 200 to 370 g/m$^2$ are used, the lower limit above which a break-at-crease does not occur has an approximately constant value (in the above example, 40 μm). And the depth of the creases 15 to 18 is a major factor in causing a conveyance failure due to hooking between the creases 15 to 18 (i.e., the other factors are not very important); for example, the diameter, the material, etc. of the feed roll 320 (see FIG. 5) have almost no influence on hooking between creases. That is, whether hooking between creases occurs or not and whether a break-at-crease occurs or not are determined by the grammage of the sheet 10 and the depth of the creases 15 to 18.

As the depth of the creases 15 to 18 is increased, hooking becomes more prone to occur at the downstream-side falling portions 15*b*, 16*b*, and 18*b* and the upstream-side rising portion 17*c* and hence the apparent static friction coefficient of conveyance of the topmost one of plural stacked sheets 10 increases. Hooking between creases comes to occur when this static friction coefficient becomes larger than the static friction coefficient of the contact between the feed roll 320 of the image forming apparatus 300 and the topmost sheet 10. Therefore, it can be said that the depth of the creases 15 to 18 should be smaller than a value above which the static friction coefficient of conveyance of the topmost sheet 10 is smaller than the static friction coefficient of the contact between the feed roll 320 and the topmost sheet 10. More specifically, a conveyance failure of the topmost sheet 10 is not prone to occur if the static friction coefficient of conveyance of the topmost sheet 10 is smaller than or equal to 0.8.

Although the sheet 10 used in the exemplary embodiment is a sheet that is formed with the concave creases 15, 16, and 18 for mountain fold and the convex crease 17 for valley fold, the invention is not limited to such a case and may employ a sheet that is formed with only a convex crease(s) or a concave crease(s).

The sheet 10 used in the exemplary embodiment is a sheet to be used for forming a flat file folder 100. In general, the term "flat file folder" means a file folder in which at least a front cover and a back cover are formed by folding a single sheet along creases and a document or the like is bound so as to be contained in the inside space between the front cover and the back cover. Therefore, it suffices that the sheet to form a flat file folder have at least a front cover portion (11) and a back cover portion (14) (see FIG. 1), that is, it need not always have a spine portion (12) or an attachment portion (13).

The sheet used in the invention need not always be made of a single material (e.g., paper); for example, it may include, in a paperboard, a sheet or the like that is made of a transparent resin material. The sheet used in the invention is not limited to a paperboard.

The sheet used in the invention may be one that is mainly used for things other than the flat file folder, such as a sheet for formation of a box (including a case that it is only a containing portion of a box or only a lid portion of a box) which is an example of a wrapping container.

A sheet for formation of a box as a wrapping container is formed in advance with many creases in vertical, horizontal, and oblique directions, and a three-dimensional box is formed by folding the sheet along these creases. In performing printing on surface portions of a sheet to become front surface portions of the box, the sheet can be set in a particular state relative to an image forming apparatus by applying the invention to the sheet.

That is, the sheet 10 according to the exemplary embodiment can be used suitably as a sheet that can be formed into what has a predetermined shape by folding it along creases.

In the case of a sheet that is formed with creases in vertical, horizontal, and oblique directions such as a sheet for formation of a box, it suffices that the invention be applied to at least creases that extend in directions that cross the conveying direction of an image forming apparatus. That is, the depths of convex or concave creases that extend in the conveying direction among the creases formed in a sheet need not always be set in the range of 40 to 90 μm.

<Creases Forming Method (First Mode of the Invention)>

Figure 7A:
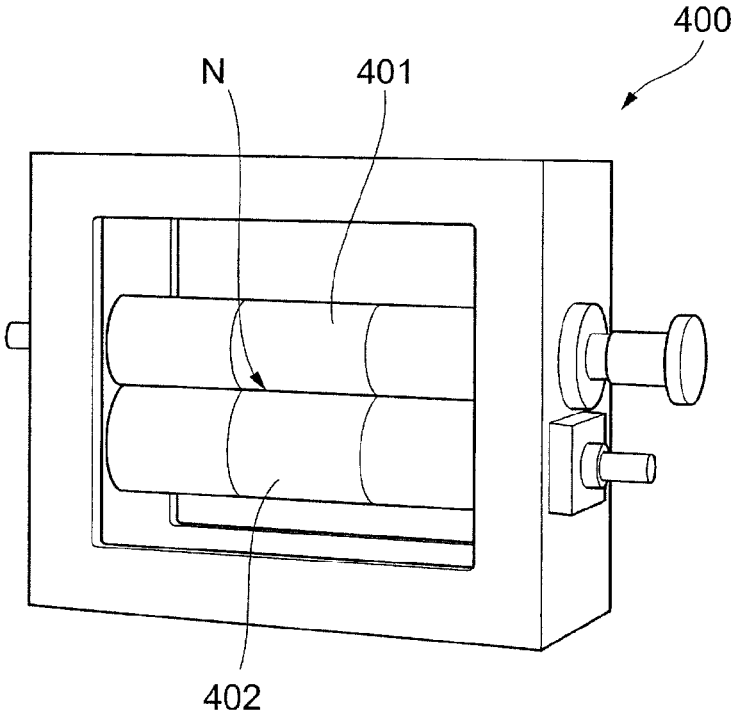
FIG. 7A is a conceptual diagram of a creases forming apparatus for forming creases.

FIG. 7A is a conceptual diagram of a creases forming apparatus 400 for forming creases 15 to 18. As shown in FIG. 7A, the creases forming apparatus 400 is equipped with a first roll 401 and a second roll 402 which are rotated in link with each other. The first roll 401 is urged against the second roll 402 and a nip portion N where a predetermined pressure is produced is formed between them. As the first roll 401 and the second roll 402 are rotated, a sheet 10 is nipped at the nip portion N, whereby creases 15 to 18 are formed.

Figure 7B:
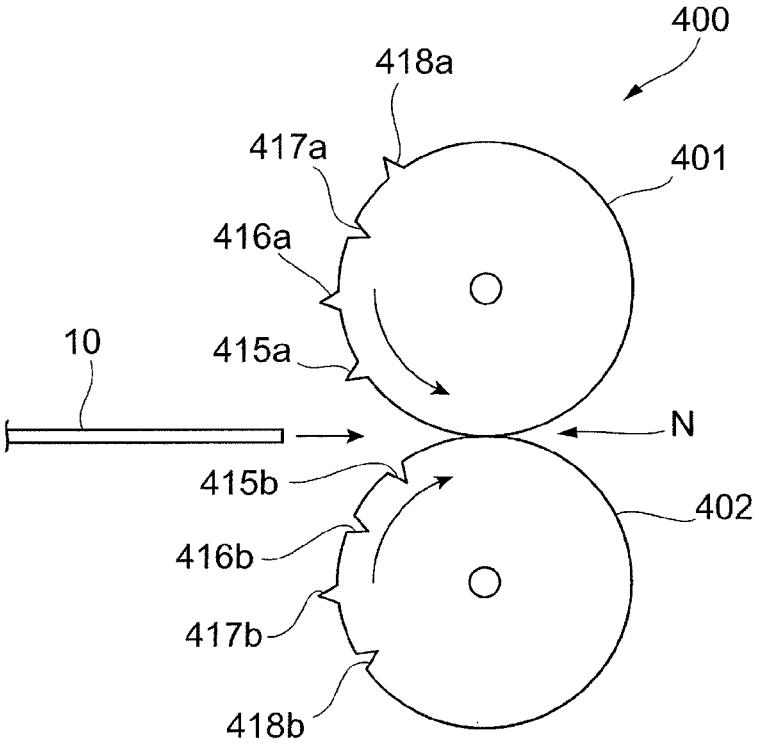
FIG. 7B is a schematic sectional view illustrating how a first roll and a second roll work.

FIG. 7B is a schematic sectional view illustrating how the first roll 401 and the second roll 402 work. As shown in FIG. 7B, the surface of the first roll 401 is formed with a projection 415*a* for formation of a crease 15, a projection 416*a* for formation of a crease 16, a recess 417*a* for formation of a crease 17, and a projection 418*a* for formation of a crease 18. Likewise, the second roll 402 is formed with a recess 415*b* for formation of a crease 15, a recess 416*b* for formation of a crease 16, a projection 417*b* for formation of a crease 17, and a recess 418*b* for formation of a crease 18. The projections 415*a*, 416*a*, 418*a*, and 417*b* and the recesses 417*a*, 415*b*, 416*b*, and 418*b* extend straightly parallel with the axes of the first roll 401 and the second roll 402.

The distance between the projections 415*a* and 416*a* as measured across the surface of the first roll 401 and the distance between the recesses 415*b* and 416*b* as measured across the surface of the second roll 402 are equal to the distance between the creases 15 and 16 in the longitudinal direction X (see FIG. 2). The distance between the projection 416*a* and the recess 417*a* as measured across the surface of the first roll 401 and the distance between the recess 416*b* and the projection 417*b* as measured across the surface of the second roll 402 are equal to the distance between the creases 16 and 17 in the longitudinal direction X. The distance between the recess 417*a* and the projection 418*a* as measured across the surface of the first roll 401 and the distance between the projection 417*b* and the recess 418*b* as measured across the surface of the second roll 402 are equal to the distance between the creases 17 and 18 in the longitudinal direction X.

As the first roll 401 and the second roll 402 are rotated, the projection 415*a* of the first roll 401 and the recess 415*b* of the second roll 402 reach the nip portion N simultaneously. Likewise, the projection 416*a* of the first roll 401 and the recess 416*b* of the second roll 402 reach the nip portion N simultaneously, the recess 417*a* of the first roll 401 and the projection 417*b* of the second roll 402 reach the nip portion N simultaneously, and the projection 418*a* of the first roll 401 and the recess 418*b* of the second roll 402 reach the nip portion N simultaneously. That is, the positions of the projections 415*a*, 416*a*, and 418*a* and the recess 417*a* on the first roll 401 and the positions of the recesses 415*b*, 416*b*, and 418*b* and the projection 417*b* on the second roll 402 are determined so that the projection 415*a* and the recess 415*b* mate with each other at the nip portion N, the projection 416*a* and the recess 416*b* mate with each other at the nip portion N, the recess 417*a* and the projection 417*b* mate with each other at the nip portion N, and the projection 418*a* and the recess 418*b* mate with each other at the nip portion N.

In the creases forming apparatus 400, when a creaseless sheet 10 is inserted into the nip portion N from the left side in FIG. 7B, first the projection 415*a* and the recess 415*b* mate with each other at the nip portion N as the first roll 401 and the second roll 402 are rotated. The sheet 10 is pressed by the pressure produced at the nip portion N, whereby a concave crease 15 is formed at the sheet 10.

As the first roll 401 and the second roll 402 are rotated further, the projection 416*a* and the recess 416*b* mate with each other at the nip portion N, whereby a concave crease 16 is formed at the sheet 10.

Likewise, as the first roll 401 and the second roll 402 are rotated further, the recess 417*a* and the projection 417*b* mate with each other at the nip portion N, whereby a convex crease 17 is formed at the sheet 10. As the first roll 401 and the second roll 402 are rotated further, the projection 418*a* and the recess 418*b* mate with each other at the nip portion N, whereby a concave crease 18 is formed at the sheet 10.

The creases 15 to 18 are formed at the sheet 10 by the creases forming apparatus 400 in the above-described manner. Although the above example is directed to the case of forming creases 15 to 18 in a single sheet 10, in actuality, from the viewpoint of production efficiency, it is preferable to form creases 15 to 18 by supplying the creases forming apparatus 400 with a long, continuous creaseless sheet that has not been cut into individual creaseless sheets having a preset size and is continuous in the longitudinal direction X (see FIG. 2). Sheets 10 are formed by forming creases 15 to 18 in the continuous sheet, then forming attachment holes 19 (see FIG. 2) by a hole forming apparatus (not shown), and finally cutting the continuous sheet by a cutting apparatus (not shown).

Examples

The first mode of the invention will be hereinafter described in more detail using Examples. However, these Examples can be modified in various manners without departing from the spirit and scope of the first mode of invention.

Figures 8A, 8B, 8C:
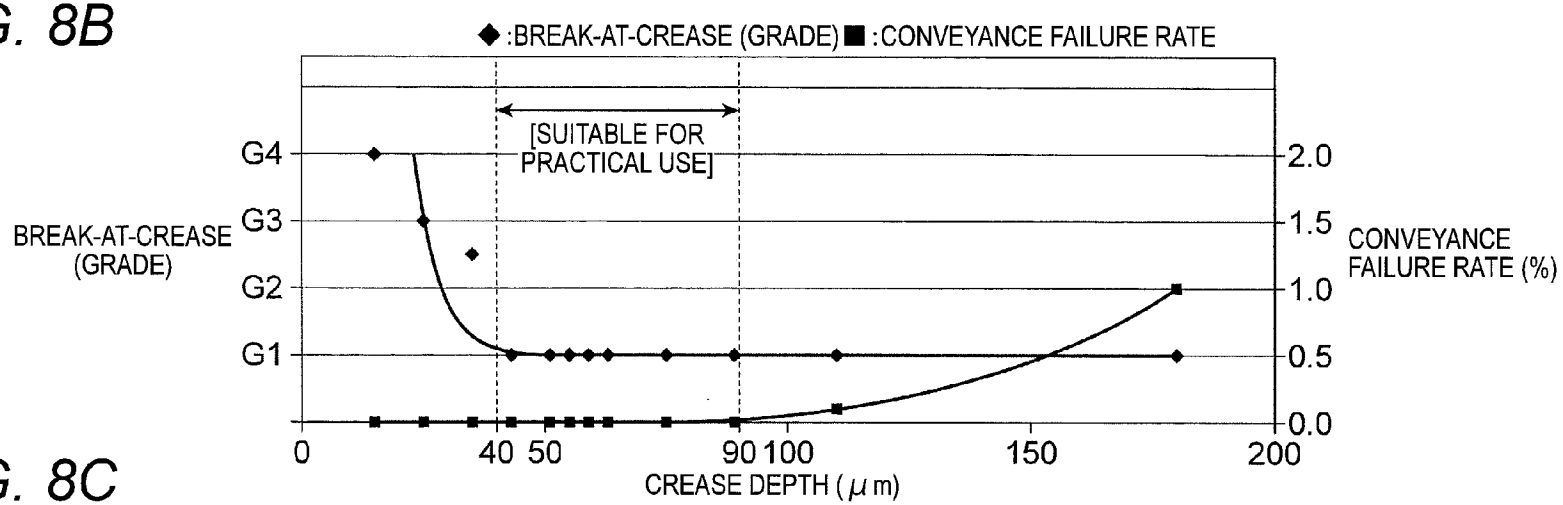
FIGS. 8A, 8B and 8C summarize Examples of a first mode of the invention.

FIGS. 8A, 8B and 8C summarize the Examples. Creaseless sheets 10 were prepared which had a size of 307 mm×520 mm and a grammage of 256 g/m$^2$. Creases 15 to 18 were formed at the sheets 10 using the creases forming apparatus 400 which has been described above with reference to FIG. 7. The depth of the creases 15 to 18 was set at 12 values that were in a range of 15 to 180 μm (see FIG. 8A).

As shown in FIG. 3, plural sheets 10 were stacked on the manual feed tray 310 of the image forming apparatus 300 and images were formed on the sheets 10 by the image forming apparatus 300.

During that course, whether hooking between creases or a break-at-crease occurred or not was checked visually. Furthermore, each sheet 10 was folded actually along the creases 15 to 18 to evaluate how easily it was folded there.

A conveyance failure rate (%) was calculated which is a rate at which sheet conveyance failures were caused by hooking between creases. Breaks-at-crease were evaluated by classifying the states of creases 15 to 18 into four grades G1 to G4 (see FIG. 8C). The degree of easiness of folding was evaluated using four grades G1 to G4 (see FIG. 8C).

The individual items were evaluated in the following manner. First, as for the hooking between creases, it was judged good only if the sheet conveyance failure rate was 0% and judged bad otherwise, that is, if a sheet conveyance failure occurred even once. As for the break-at-crease, it was judged good if its grade was G1 or G2 and judged band if its grade was G3 or G4. As for the degree of easiness of folding, it was judged good if its grade was G1 or G2 and judged band if its grade was G3 or G4.

FIGS. 8A and 8B show evaluation results. Sheet conveyance failures occurred in Examples with crease depths 110 μm and 180 μm. On the other hand, no conveyance failures occurred, that is, the sheet conveyance failure rate was 0%, in Examples with crease depths of 89 μm or less.

Breaks-at-crease occurred in Examples with crease depths 15 μm, 25 μm, and 35 μm. On the other hand, no breaks-at-crease occurred in Examples with crease depths of 43 μm or more.

Based on the above evaluation results, we judged that neither sheet conveyance failures nor breaks-at-crease occur and sheets are not difficult to fold when the crease depth is in the range of 40 to 90 μm.

<Details of Creases of Sheet (Second Mode of the Invention)>

Figure 9A:
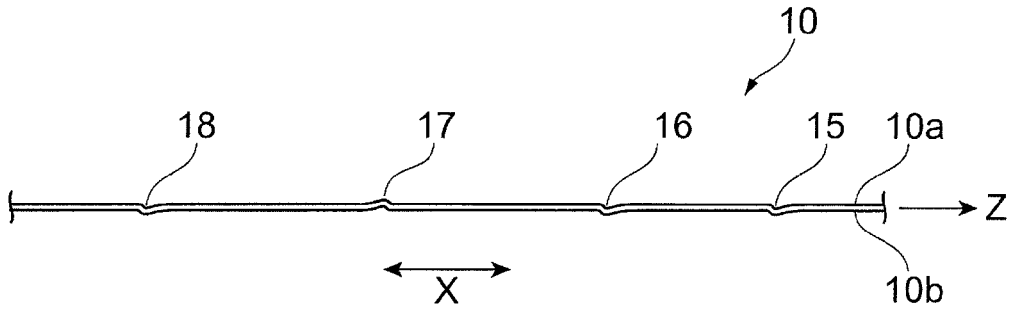
FIG. 9A is a sectional view taken along line IV-IV in FIG. 2.
Figure 9B:
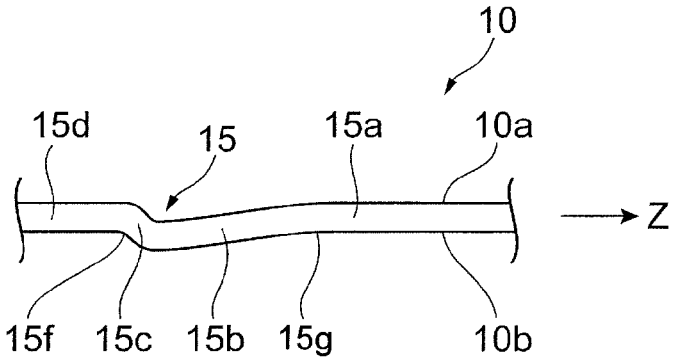
FIG. 9B is an enlarged view of a concave crease in FIG. 9A.
Figure 9C:
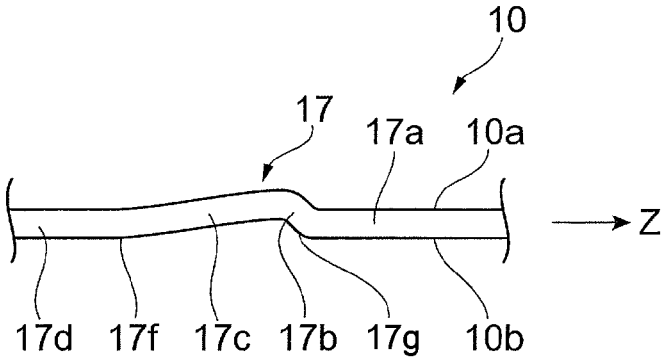
FIG. 9C is an enlarged view of a convex crease in FIG. 9A.

FIG. 9A is a sectional view taken along line TV-TV in FIG. 2, FIG. 9B is an enlarged view of the concave crease 15 in FIG. 9A, and FIG. 9C is an enlarged view of the convex crease 17 in FIG. 9A. When as shown in FIG. 3 a sheet 10 is placed on the manual feed tray 310 with its front surface 10*a* up and the front cover portion 11 is located on the downstream side in the conveying direction Z, as shown in FIG. 9A the creases 15, 16, and 18 for mountain fold of the sheet 10 are concave upward (i.e., recessed downward). On the other hand, the crease 17 for valley fold of the sheet 10 is convex upward.

As shown in FIG. 9B, in the concave crease 15 for mountain fold, a downstream-side falling portion 15*b* is inclined more gently than an upstream-side falling portion 15*c*. The downstream-side falling portion 15*b* is a falling portion, adjacent to a flat portion 15*a* that is located downstream of the crease 15 in the conveying direction Z, of the crease 15. The upstream-side falling portion 15*c* is a falling portion, adjacent to a flat portion 15*d* that is located upstream of the crease 15 in the conveying direction Z, of the crease 15.

The gentle slope of the downstream-side falling portion 15*b* is such that when plural sheets 10 are stacked on the manual feed tray 310 of the image forming apparatus 300 in the manner shown in FIG. 3 the static friction force acting on the topmost sheet 10 from the immediately underlying sheet 10 upstream in the conveying direction Z is weaker than the conveying force of the image forming apparatus 300 that acts on the topmost sheet 10 downstream in the conveying direction Z.

On the other hand, the slope of the upstream-side falling portion 15*c*, which is steeper than that of the downstream-side falling portion 15*b*, is such as not to cause a break-at-crease (e.g., paper layer breaks or fiber fluffing) when the sheet 10 is folded along the crease 15 so as to form a mountain fold.

Although not shown in any drawings, like the crease 15, each of the other concave creases 16 and 18 for mountain fold is formed in such a manner that a downstream-side falling portion is gentler than an upstream-side falling portion.

As shown in FIG. 9C, in the convex crease 17 for valley fold, an upstream-side falling portion 17*c* is inclined more gently than a downstream-side falling portion 17*b*. The downstream-side falling portion 17*b* is a falling portion, adjacent to a flat portion 17*a* that is located downstream of the crease 17 in the conveying direction Z, of the crease 17. The upstream-side falling portion 17*c* is a falling portion, adjacent to a flat portion 17*d* that is located upstream of the crease 17 in the conveying direction Z, of the crease 17.

The gentle slope of the upstream-side falling portion 17*c* is such that when plural sheets 10 are stacked on the manual feed tray 310 of the image forming apparatus 300 in the manner shown in FIG. 3 the static friction force acting on the topmost sheet 10 from the immediately underlying sheet 10 upstream in the conveying direction Z is weaker than the conveying force of the image forming apparatus 300 that acts on the topmost sheet 10 downstream in the conveying direction Z.

On the other hand, the slope of the downstream-side falling portion 17*b*, which is steeper than that of the upstream-side falling portion 17*c*, is such as not to cause a break-at-crease (e.g., paper layer breaks or fiber fluffing) when the sheet 10 is folded along the crease 17 so as to form a valley fold.

Figure 10:
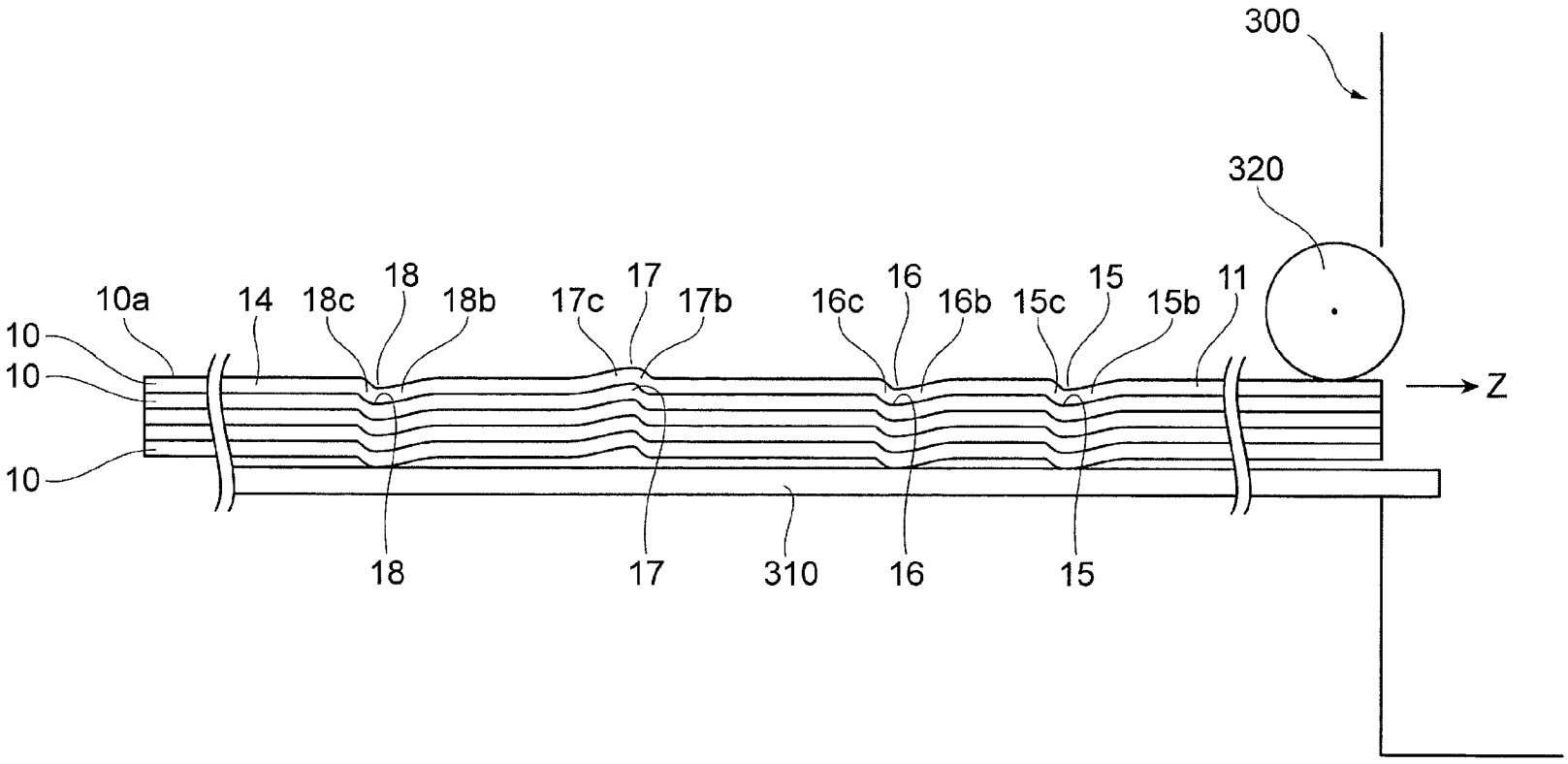
FIG. 10 is a schematic sectional view showing how plural sheets are stacked on the manual feed tray of the image forming apparatus.
Figure 11:
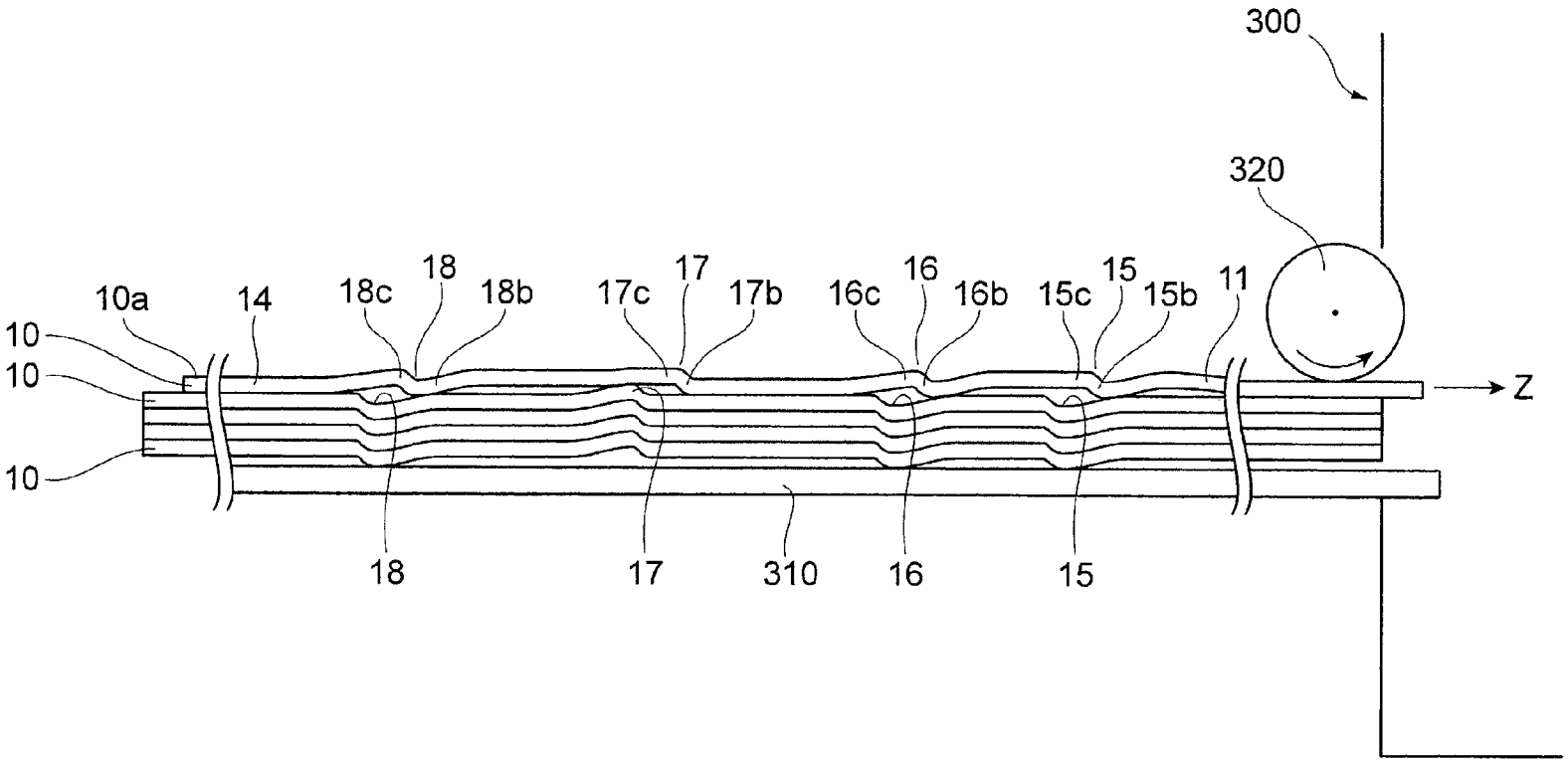
FIG. 11 is a schematic sectional view, which corresponds to FIG. 10, showing how the topmost one of the sheets shown in FIG. 10 is conveyed in the conveying direction.

FIG. 10 is a schematic sectional view showing how plural sheets 10 are stacked on the manual feed tray 310 of the image forming apparatus 300. FIG. 11 is a schematic sectional view, which corresponds to FIG. 10, showing how the topmost one of the sheets 10 shown in FIG. 10 is conveyed in the conveying direction Z.

In the exemplary embodiment, as shown in FIG. 10, plural sheets 10 are stacked and set on the manual feed tray 310 of the image forming apparatus 300. As shown in FIG. 11, the plural sheets 10 thus set are conveyed in the conveying direction Z one by one starting from the topmost one.

Now suppose that like the upstream-side falling portion 15*c* the downstream-side falling portion 15*b* of the concave crease 15 has a slope that is steep but is such as not to cause a break-at-crease (the other concave creases 16 and 18 are formed in the same manner as the concave crease 15). In this case, the crease 15 (16 or 18) of the topmost sheet 10 being conveyed might be caught on that of the immediately underlying sheet 10.

Also suppose that like the downstream-side rising portion 17*b* the upstream-side rising portion 17*c* of the convex crease 17 has a slope that is steep but is such as not to cause a break-at-crease. Also in this case, the crease 17 of the topmost sheet 10 being conveyed might be caught on that of the immediately underlying sheet 10.

Actually, however, the sheet 10 used in the exemplary embodiment is formed in such a manner that the downstream-side falling portion 15*b* of the concave crease 15 is inclined more gently than its upstream-side falling portion 15*c* (the other concave creases 16 and 18 are formed in the same manner as the concave crease 15) and the upstream-side rising portion 17*c* of the convex crease 17 is inclined more gently than its downstream-side rising portion 17*b*.

Therefore, as shown in FIG. 11, when the topmost sheet 10 is conveyed in the conveying direction Z, the downstream-side falling portions 15*b*, 16*b*, and 18*b* of the concave creases 15, 16, and 18 of the topmost sheet 10 are not caught on those of the immediately underlying sheet 10, respectively. Likewise, the upstream-side rising portion 17*c* of the convex crease 17 is not caught on that of the immediately underlying sheet 10

That is, in the exemplary embodiment, when plural stacked sheets 10 are conveyed one by one in the conveying direction Z, no hooking occurs between the topmost sheet 10 and the immediately underlying sheet 10. As a result, the conveyance of the topmost sheet 10 by the image forming apparatus 300 in the conveying direction Z is not obstructed.

As shown in FIG. 9B, the sheet 10 used in the exemplary embodiment is formed in such a manner that a downstream-side falling bent portion 15*g* that connects the downstream-side falling portion 15*b* of the concave crease 15 and the flat portion 15*a* which is located downstream of the downstream-side falling portion 15*b* is smaller in curvature than an upstream-side falling bent portion 15*f* that connects the upstream-side falling portion 15*c* and the upstream-side flat portion 15*d* which is located upstream of the upstream-side falling portion 15*c*.

As a result, in the sheet 10 used in the exemplary embodiment, the friction force can be reduced that the downstream-side falling bent portion 15*g* of the concave crease 15 of the top most sheet 10 receives from the immediately underlying sheet 10 when the topmost sheet 10 is conveyed in the conveying direction Z.

Although not shown in any drawings, like the crease 15, each of the other concave creases 16 and 18 is formed in such a manner that a downstream-side falling bent portion is smaller in curvature than an upstream-side falling bent portion and hence the friction force can be reduced that the downstream-side falling bent portion of each of the concave creases 16 and 18 receives from the immediately underlying sheet 10 (see FIG. 10).

As shown in FIG. 9C, the sheet 10 used in the exemplary embodiment is formed in such a manner that an upstream-side rising bent portion 17*f* that connects the upstream-side rising portion 17*c* of the convex crease 17 and the flat portion 17*d* which is located upstream of the upstream-side rising portion 17*c* is smaller in curvature than a downstream-side rising bent portion 17*g* that connects the downstream-side rising portion 17*b* and the downstream-side flat portion 17*a* which is located downstream of the downstream-side rising portion 17*b*.

As a result, in the sheet 10 used in the exemplary embodiment, the friction force can be reduced that the upstream-side rising bent portion 17*f* of the convex crease 17 of the top most sheet 10 receives from the immediately underlying sheet 10 when the topmost sheet 10 is conveyed in the conveying direction Z.

Although the sheet 10 used in the exemplary embodiment is a sheet that is formed with the concave creases 15, 16, and 18 for mountain fold and the convex crease 17 for valley fold, the invention is not limited to such a case and may employ a sheet that is formed with only a convex crease(s) or a concave crease(s).

The sheet 10 used in the exemplary embodiment is a sheet to be used for forming a flat file folder 100. In general, the term "flat file folder" means a file folder in which at least a front cover and a back cover are formed by folding a single sheet along creases and a document or the like is bound so as to be contained in the inside space between the front cover and the back cover. Therefore, it suffices that the sheet to form a flat file folder have at least a front cover portion (11) and a back cover portion (14) (see FIG. 1), that is, it need not always have a spine portion (12) or an attachment portion (13).

The sheet used in the invention need not always be made of a single material (e.g., paper); for example, it may include, in a paperboard, a sheet or the like that is made of a transparent resin material. The sheet used in the invention is not limited to a paperboard.

The sheet used in the invention may be one that is mainly used for things other than the flat file folder, such as a sheet for formation of a box (including a case that it is only a containing portion of a box or only a lid portion of a box) which is an example of a wrapping container.

A sheet for formation of a box as a wrapping container is formed in advance with many creases in vertical, horizontal, and oblique directions, and a three-dimensional box is formed by folding the sheet along these creases. In performing printing on surface portions of a sheet to become front surface portions of the box, the sheet can be set in a particular state relative to an image forming apparatus by applying the invention to the sheet.

In the case of a sheet that is formed with creases in vertical, horizontal, and oblique directions such as a sheet for formation of a box, it suffices that the invention be applied to at least creases that extend in directions that cross the conveying direction of an image forming apparatus. That is, in each convex crease that extends in the conveying direction among the creases formed in a sheet, the upstream-side rising portion need not always be inclined more gently than the downstream-side rising portion. Likewise, in each concave crease that extends in the conveying direction among the creases formed in a sheet, the downstream-side falling portion need not always be inclined more gently than the upstream-side falling portion.

<Creases Forming Method (Second Mode of the Invention)>

Figure 12A:
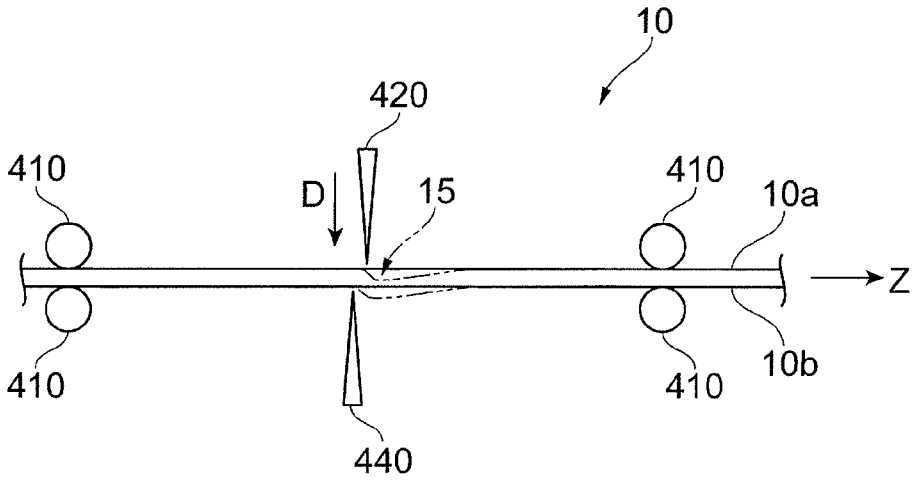
FIGS. 12A and 12B are schematic sectional views illustrating an example manufacturing method of a sheet.
Figure 12B:
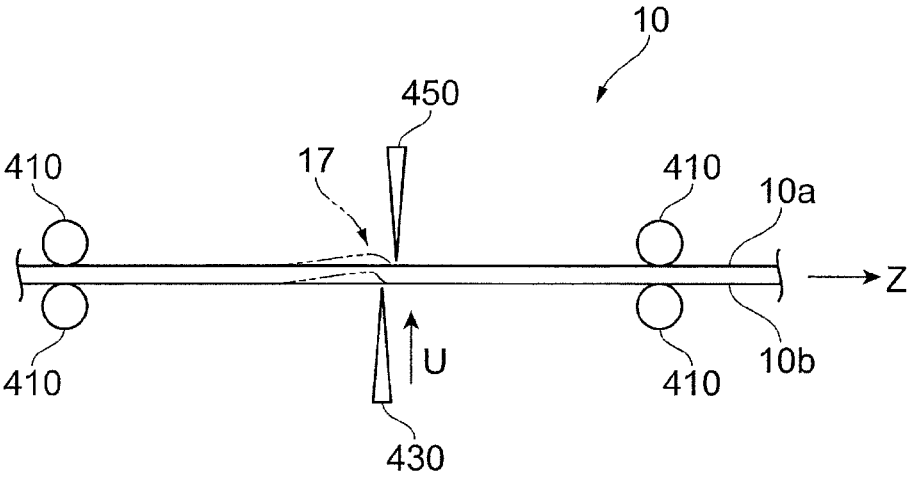

FIGS. 12A and 12B are schematic sectional views illustrating an example manufacturing method of a sheet 10; FIG. 12A illustrates how to form a concave crease 15 and FIG. 12B illustrates how to form a convex crease 17. To form a concave crease 15 in, for example, a single sheet 10 having a preset size that was obtained in advance by cutting is held stationarily by pairs of sheet holding members 410 (see FIG. 12A). The pairs of sheet holding members 410 are disposed at two or more locations in the conveying direction Z of the sheet 10 and hold the sheet 10 so that it is kept flat.

A creasing movable blade 420 and a receiving blade 440 which receives the movable blade 420 are disposed between two locations where respective pairs of sheet holding members 410 are disposed. The movable blade 420 is disposed on the side of the front surface 10*a* of the sheet 10 and is moved so as to be lowered (downward in FIG. 12A) and then elevated to the original position. The receiving blade 440 is disposed on the side of the back surface 10*b* of the sheet 10 upstream of the movable blade 420 in the conveying direction Z so as to form a very small gap between itself and the movable blade 420.

The movable blade 420 is lowered so as to push the sheet 10 downward which is held flat by the pairs of sheet holding members 410, whereby a recessed, concave crease 15 is formed at the sheet 10.

Since the receiving blade 440 is disposed upstream of the movable blade 420 in the conveying direction Z, an upstream-side portion (upstream-side falling portion 15*c* (see FIG. 9B)), located upstream of the movable blade 420 in the conveying direction Z, of an intended crease 15 is nipped strongly by the movable blade 420 and the receiving blade 440. On the other hand, a downstream-side portion (downstream-side falling portion 15*b* (see FIG. 9B)), located downstream of the movable blade 420 in the conveying direction Z, of the crease 15 is merely pushed downward weakly.

As a result, a crease 15 is formed in which the downstream-side falling portion 15*b* is inclined more gently than the upstream-side falling portion 15*c*. The other concave creases 16 and 18 can be formed in the same manner as the concave crease 15.

To form a convex crease 17 in, for example, a single sheet 10 having a preset size that was obtained in advance by cutting is held stationarily by pairs of sheet holding members 410 (see FIG. 12B). The pairs of sheet holding members 410 are disposed at two or more locations in the conveying direction Z of the sheet 10 and hold the sheet 10 so that it is kept flat.

A creasing movable blade 430 and a receiving blade 450 which receives the movable blade 430 are disposed between two locations where respective pairs of sheet holding members 410 are disposed. The movable blade 430 is disposed on the side of the back surface 10*b* of the sheet 10 and is moved so as to be elevated (upward in FIG. 12A) and then lowered to the original position. The receiving blade 450 is disposed on the side of the front surface 10*a* of the sheet 10 downstream of the movable blade 430 in the conveying direction Z so as to form a very small gap between itself and the movable blade 430.

The movable blade 430 is elevated so as to push the sheet 10 upward which is held flat by the pairs of sheet holding members 410, whereby a projected, convex crease 17 is formed at the sheet 10.

Since the receiving blade 450 is disposed downstream of the movable blade 430 in the conveying direction Z, a downstream-side portion (downstream-side rising portion 17*b* (see FIG. 9C)), located downstream of the movable blade 430 in the conveying direction Z, of an intended crease 17 is nipped strongly by the movable blade 430 and the receiving blade 450. On the other hand, an upstream-side portion (upstream-side rising portion 17*c* (see FIG. 9C)), located upstream of the movable blade 420 in the conveying direction Z, of the crease 17 is merely pushed upward weakly.

As a result, a crease 17 is formed in which the upstream-side rising portion 17*c* is inclined more gently than the downstream-side rising portion 17*b*.

Figure 13:
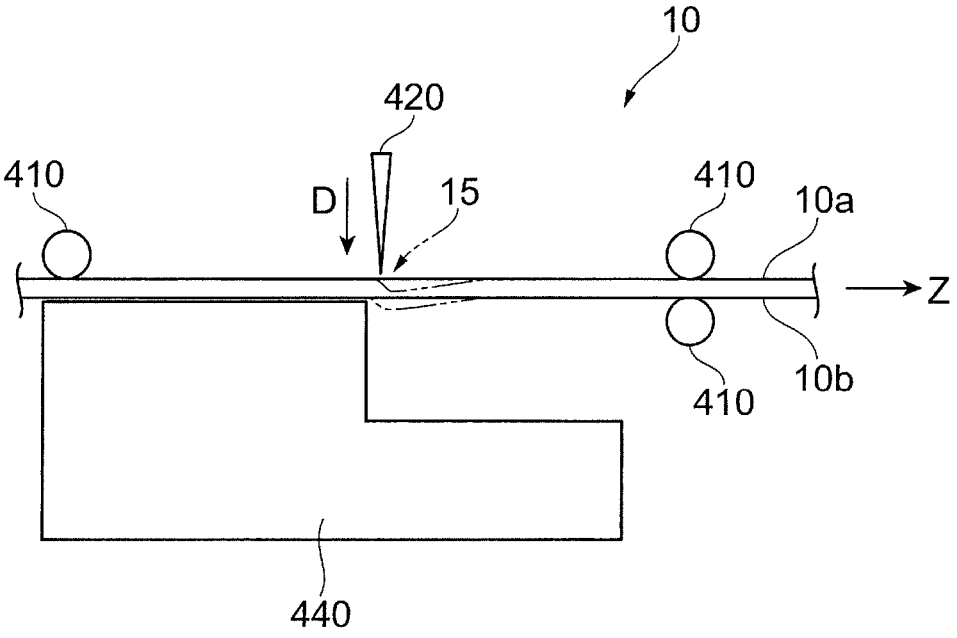
FIG. 13 is a schematic sectional view illustrating an example manufacturing method of a sheet which corresponds to the manufacturing method of FIG. 12A and in which a receiving blade incorporates part of sheet holding members.

FIG. 13 is a schematic sectional view illustrating an example manufacturing method of a sheet 10 which corresponds to the manufacturing method of FIG. 12A and in which the receiving blade 440 incorporates part of the sheet holding members 410. The manufacturing of FIG. 13 is the same as that of FIG. 12A except that a sheet 10 held by the pair(s) of sheet holding members 410 and the receiving blade 440.

Figure 14:
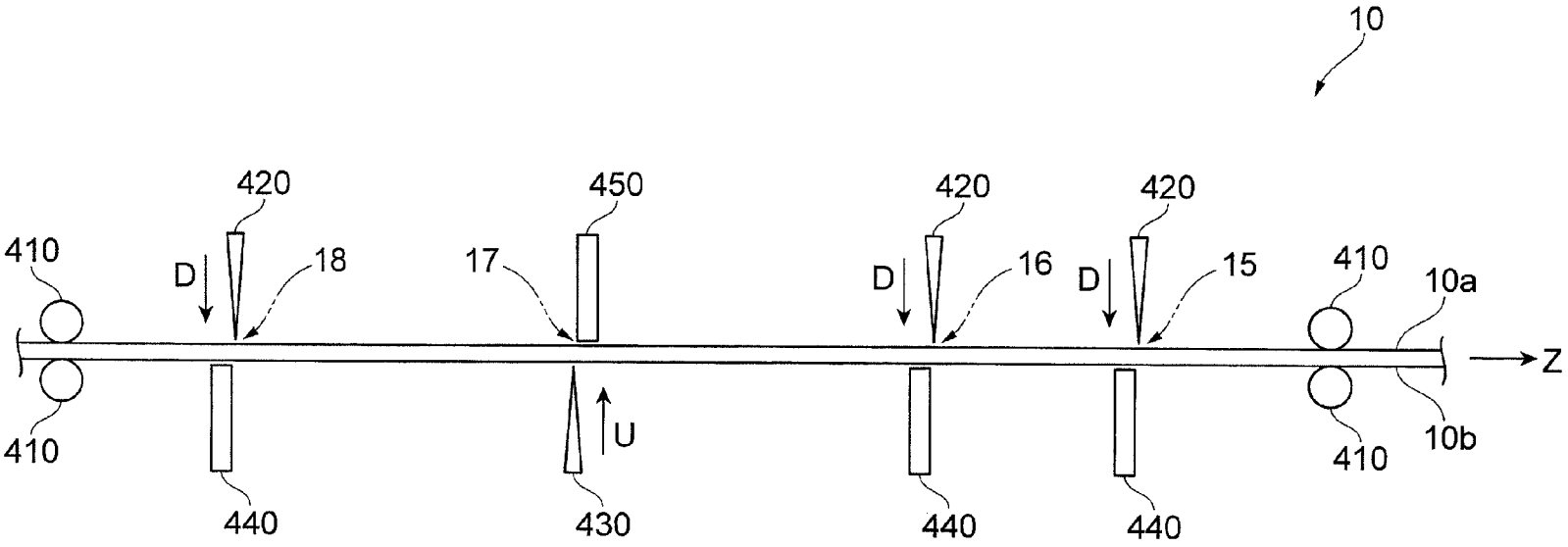
FIG. 14 is a schematic sectional view illustrating an example manufacturing method for forming four creases by a single step.

FIG. 14 is a schematic sectional view illustrating an example manufacturing method for forming four creases 15 to 18 by a single step. The manufacturing method of a sheet 10 shown in FIG. 14 is a manufacturing method in which the step of FIG. 12A for forming a concave crease 15, steps for forming the other concave creases 16 and 18 which are the same as the step of FIG. 12A, and a step of FIG. 12B for forming a convex crease 17 are combined into a single step. The operations for forming the respective 15 to 18 are the same as those described above with reference to FIGS. 12A and 12B, and hence will not be described redundantly.

The sheet manufacturing method of the invention is not limited to the above-described methods in which creases are formed in a stationary sheet, but encompasses methods in which creases are formed as a long sheet that has not been cut into individual sheets having a preset size and is thus continuous in the longitudinal direction X (see FIG. 2) is fed in the longitudinal direction X.

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention defined by the following claims and their equivalents.

What is claimed is:

1. A sheet, wherein a conveying direction of the sheet relative to a sheet conveying apparatus is determined;

the sheet is formed with a crease along which to fold the sheet and that is smaller than or equal to 90 μm in depth and extends in a direction that crosses the conveying direction; and a grammage of the sheet is in a range of 200 to 370 g/m$^2$.

2. The sheet according to claim 1, wherein the depth of the crease is larger than or equal to 40 μm.

3. The sheet according to claim 1, wherein a coefficient of static friction that occurs in conveying a topmost one of a plurality of the sheets stacked is smaller than or equal to 0.8.

4. The sheet according to claim 1, wherein a predetermined shape of the sheet is formed when the sheet is folded along the crease.

5. The sheet according to claim 1, which is formed into a flat file folder when folded along the crease.

6. A sheet wherein:

a conveying direction of the sheet relative to a sheet conveying apparatus is determined; and the sheet is formed with a crease that has a predetermined depth and extends in a direction that crosses the conveying direction, the predetermined depth being larger than a value below which a break-at-crease occurs when the sheet is folded at the crease and smaller than a depth above which a conveyance failure occurs due to hooking between the crease of a topmost one of a plurality of the sheets stacked on a sheet bearing unit of the sheet conveying apparatus and the crease of a sheet immediately underlying the topmost sheet in conveying the topmost sheet.

7. A sheet conveying apparatus comprising a conveying unit that conveys a sheet, and a sheet bearing unit on which the sheet to be conveyed is placed, wherein:

a conveying direction relative to the sheet conveying apparatus is determined for the sheet to be placed on the sheet bearing unit;

the sheet is formed with a crease that is smaller than or equal to 90 μm in depth and extends in a direction that crosses the conveying direction; and a grammage of the sheet is in a range of 200 to 370 g/m$^2$.

8. The sheet conveying apparatus according to claim 7, the depth of the crease is larger than or equal to 40 μm.

9. A sheet conveying method, which comprises: conveying a sheet for which a conveying direction relative to a sheet conveying apparatus is determined, wherein a grammage of the sheet is in a range of 200 to 370 g/m$^2$ and is formed with a crease that is smaller than or equal to 90 μm in depth and extends in a direction that crosses the conveying direction.

10. The sheet conveying method according to claim 9, wherein the depth of the crease is larger than or equal to 40 μm.

11. A sheet, wherein a conveying direction of the sheet relative to a sheet conveying apparatus is determined;

the sheet is formed with a crease along which to fold the sheet and that extends in a direction that crosses the conveying direction;

in case the crease is convex upward in a state that the sheet is placed on a sheet bearing unit of the sheet conveying apparatus, an upstream-side rising portion, in the conveying direction, of the crease is inclined more gently than a downstream-side rising portion of the crease; and in case the crease is concave upward in a state that the sheet is placed on the sheet bearing unit of the sheet conveying apparatus, a downstream-side falling portion, in the conveying direction, of the crease is inclined more gently than an upstream-side falling portion of the crease.

12. The sheet according to claim 11, wherein the sheet is formed with a convex crease in which the upstream-side rising portion is inclined more gently than the downstream-side rising portion and a concave crease in which the downstream-side falling portion is inclined more gently than the upstream-side falling portion.

13. The sheet according to claim 11, wherein in the convex crease an upstream-side rising bent portion that connects the upstream-side rising portion and an upstream-side flat portion that is located upstream of the upstream-side rising portion is smaller in curvature than a downstream-side rising bent portion that connects the downstream-side rising portion and a downstream-side flat portion that is located downstream of the downstream-side rising portion.

14. The sheet according to any claim 11, wherein in the concave crease a downstream-side falling bent portion that connects the downstream-side falling portion and a downstream-side flat portion that is located downstream of the downstream-side falling portion is smaller in curvature than an upstream-side falling bent portion that connects the upstream-side falling portion and an upstream-side flat portion that is located upstream of the upstream-side falling portion.

15. The sheet according to claim 11, wherein the sheet is used for formation of a flat file folder.

16. A sheet, wherein a conveying direction of the sheet relative to a sheet conveying apparatus is determined;

the sheet is formed with a crease along which to fold the sheet and that extends in a direction that crosses the conveying direction;

in case the crease is convex upward in a state that the sheet is placed on a sheet bearing unit of the sheet conveying apparatus, an upstream-side rising bent portion that connects an upstream-side rising portion in the conveying direction and an upstream-side flat portion that is located upstream of the upstream-side rising portion is smaller in curvature than a downstream-side rising bent portion that connects a downstream-side rising portion in the conveying direction and a downstream-side flat portion that is located downstream of the downstream-side rising portion; and in case the crease is concave upward in a state that the sheet is placed on the sheet bearing unit of the sheet conveying apparatus, a downstream-side falling bent portion that connects a downstream-side falling portion in the conveying direction and a downstream-side flat portion that is located downstream of the downstream-side falling portion is smaller in curvature than an upstream-side falling bent portion that connects an upstream-side falling portion in the conveying direction and an upstream-side flat portion that is located upstream of the upstream-side falling portion.

17. The sheet according to claim 16, wherein the sheet is formed with a convex crease in which the upstream-side rising bent portion is smaller in curvature than the downstream-side rising bent portion and a concave crease in which the downstream-side falling bent portion is smaller in curvature than the upstream-side bent falling portion.

* * * * *